US008827100B2

(12) United States Patent
Sewell

(10) Patent No.: US 8,827,100 B2
(45) Date of Patent: Sep. 9, 2014

(54) INKJET PRINTING

(75) Inventor: David Sewell, Cambridgeshire (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 12/864,787

(22) PCT Filed: Nov. 13, 2009

(86) PCT No.: PCT/GB2009/002657

§ 371 (c)(1),
(2), (4) Date: Jul. 27, 2010

(87) PCT Pub. No.: WO2010/055299

PCT Pub. Date: May 20, 2010

(65) Prior Publication Data

US 2010/0314350 A1 Dec. 16, 2010

(30) Foreign Application Priority Data

Nov. 14, 2008 (GB) ..... 0820850.6

(51) Int. Cl.

| | |
|---|---|
| ***B65D 17/42*** | (2006.01) |
| ***B65D 50/06*** | (2006.01) |
| ***B65D 47/10*** | (2006.01) |
| *B65D 17/28* | (2006.01) |

(52) U.S. Cl.
CPC ..... *B65D 47/106* (2013.01); *B65D 50/067* (2013.01)
USPC ..... 220/274; 215/48; 220/284

(58) Field of Classification Search
USPC ..... 220/274, 275, 266, 277; 215/47, 48
See application file for complete search history.

(56) References Cited

U.S. PATENT DOCUMENTS

| | | | | |
|---|---|---|---|---|
| 3,416,712 | A * | 12/1968 | Shastal | 222/541.5 |
| 4,098,417 | A * | 7/1978 | Bennett | 215/204 |
| 4,355,729 | A | 10/1982 | Maguire | |
| 4,598,839 | A * | 7/1986 | Dombroski et al. | 222/92 |
| 4,688,703 | A * | 8/1987 | Bayer | 222/541.8 |
| 4,773,548 | A * | 9/1988 | Deussen | 222/541.7 |
| 5,106,326 | A * | 4/1992 | Tsuji et al. | 439/596 |
| 5,228,593 | A * | 7/1993 | O'Meara | 222/41 |
| 5,586,672 | A * | 12/1996 | Schneider et al. | 215/250 |
| 5,743,425 | A | 4/1998 | Ellis | |
| 6,279,600 | B1 * | 8/2001 | Robinson | 137/232 |
| 6,382,438 | B1 * | 5/2002 | Schneider et al. | 215/48 |
| 7,614,514 | B2 * | 11/2009 | Fuchs | 215/256 |

FOREIGN PATENT DOCUMENTS

| | | |
|---|---|---|
| FR | 2369976 | 6/1978 |
| GB | 2179641 | 3/1987 |
| WO | 9958414 | 11/1999 |

OTHER PUBLICATIONS

Chinese Office Action dated May 23, 2011 for Appln. No. 200980101459.8.
Instructions for responding to Chinese Office Action dated May 23, 2011 for Appln. No. 200980101459.8.

(Continued)

*Primary Examiner* — Mickey Yu
*Assistant Examiner* — Niki Eloshway
(74) *Attorney, Agent, or Firm* — Price Heneveld LLP

(57) ABSTRACT

The invention describes a bottle cap in which a detachable section (9) can be ruptured from the remainder of the cap using a common tool such as, for example, a hex key. A frangible seal (13), recessed below the upper surface (6) of the cap, connects the detachable section to the remainder of the cap and thus, when the detachable section is withdrawn, the risk of spillage is minimized.

7 Claims, 2 Drawing Sheets

(56) References Cited

OTHER PUBLICATIONS

Chinese Office Action dated Jan. 18, 2012 for Appln. No. 200980101459.8.

Instructions for responding to Chinese Office Action dated Jan. 18, 2012 for Appln. No. 200980101459.8.

Response submitted Jul. 14, 2010 to International Search Report for European Application No. 09760257.7.

* cited by examiner

INKJET PRINTING

FIELD OF THE INVENTION

This invention relates to inkjet printing and in particular, to the provision and arrangement of a consumable item used in inkjet printing.

BACKGROUND TO THE INVENTION

Inkjet printers consume ink and, in many cases, solvent make-up. The ink and solvent make-up are typically supplied in disposable bottles. The bottles, and the printer in which the bottles are to be used, typically have mating features to allow fluids to be drawn from the bottles, and supplied into the printer.

Each ink bottle retains a finite amount of ink, typically a pint or liter of ink. As the inkjet printing system is used, the ink within the bottle is consumed. When the ink bottle is fully drained, the depleted ink bottle is removed and replaced with a new ink bottle.

In the course of replacing the ink bottle, excess ink may spill or leak. For example, when an operator grasps the ink bottle to replace it, the force applied may squeeze the ink bottle, thereby ejecting excess ink from the bottle. Ink spills produce a mess within the ink jet printing system, and possibly outside of the system e.g. on the surrounding flooring and on an operator, and are potentially a health and safety hazard.

Some manufacturers of inkjet printing systems provide ink bottles or solvent bottles with spring-loaded valves to prevent spillage when ink bottles are removed from, or added to, a printer. Typically the valve assembly is located within the consumables bottle and an additional capping feature is added externally to provide a permanent seal to the container, and prevent the sprung valve from being dislodged during transportation.

The consumable fluids of an inkjet system comprise or include volatile organic substances. When a sealed bottle is transported the bottle is not only subjected to a range of vibrations and shocks that could dislodge the spring-loaded valve but also, the consumables bottles may be subjected to a range of internal pressures caused by differences in vapour pressure arising from differing environmental temperatures found around the world. The external sealing bottle cap therefore needs to be robust and able to withstand pressures both higher and lower than atmospheric pressure. These changes in internal pressure tend to generate a force along the axis of the bottle and thus the cap must be particularly robust in that axis.

Additionally the cap of the bottle should not add significantly to the external dimensions of the container, and therefore to the volume of any secondary containers required by law for transportation of the bottle.

One existing form of transportation cap comprises a single piece of plastic that is snap-fitted onto the body of the container to form a permanent seal. The cap has a raised section, which is removed by a cutting action performed by a specially designed tool. The removal of the cap section by cutting is a potential hazard as it involves a sharpened edge that may also cut the user.

An alternative arrangement is the ring tab such as that found on many food containers. As is well known the tab, defined by a thinned line formed in the cap, is removed to open the container by pulling on a ring attached to the tab. This is not preferred for ink containers because a stronger joint is required than that which can be removed by a pulling action; and because of the additional volume occupied by the ring. Further, the jerking action which typically results when the tab is broken from the surrounding cap, can lead to spillage of the ink.

U.S. Pat. No. 5,222,530, International Patent Application 02/060808 and International Patent Application 2004/108584 all show forms of bottle cap in which a plug, integrally formed with the cap, is broken away from the remainder of the cap by a force applied along the axis of the bottle to which the cap is attached. This requires the cap to be weaker in the axial direction which, for the reasons stated above, is undesirable for the transport of inks. Further, breaking such plugs away from the remainder of the cap could easily lead to spillage.

An alternative form of frangible cap is shown in U.S. Pat. No. 4,355,729. The cap described in this patent is provided with a breakaway part having a prying bar under which the head of a screw driver may be located to pry the breakaway part from the remainder of the cap. Again the breakaway part is connected to the remainder of the cap by a joint which is particularly weak along the bottle axis and, again, the prying action could well lead to spillage upon the breakaway part detaching from the remainder of the cap.

It is an object of this invention to provide a method and/or apparatus which addresses the problems and considerations set forth above; or which at least offers a novel and useful alternative.

SUMMARY OF THE INVENTION

Accordingly, in one aspect, the invention provides a bottle cap having an upper boundary and an attachment skirt depending from, and below, said upper boundary, said bottle cap having a detachable section formed integrally with said upper boundary, said bottle cap being characterized in that said detachable section has a tool engagement socket projecting below said upper boundary, said socket being configured to allow the application of torque to said detachable section.

Preferably said detachable section is connected to the remainder of said cap by a frangible joint.

Preferably said frangible joint is located below said upper boundary.

Preferably said frangible joint is aligned substantially vertically between said detachable section and the remainder of said cap.

Preferably said socket projects below said frangible joint.

Preferably said cap has an axis of symmetry passing through said upper boundary and co-axial with said attachment skirt, said cap being configured and arranged so that said detachable section is, in use, detached by the application of torque to said tool engagement socket substantially about said axis of symmetry.

Preferably said tool engagement socket is configured to receive a hexagonal key.

In a second aspect the invention provides a consumables bottle for an inkjet printer having a bottle cap as set forth above.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The invention will now be described with reference to the accompanying drawings in which.

DESCRIPTION OF WORKING EMBODIMENTS

Figure 1:
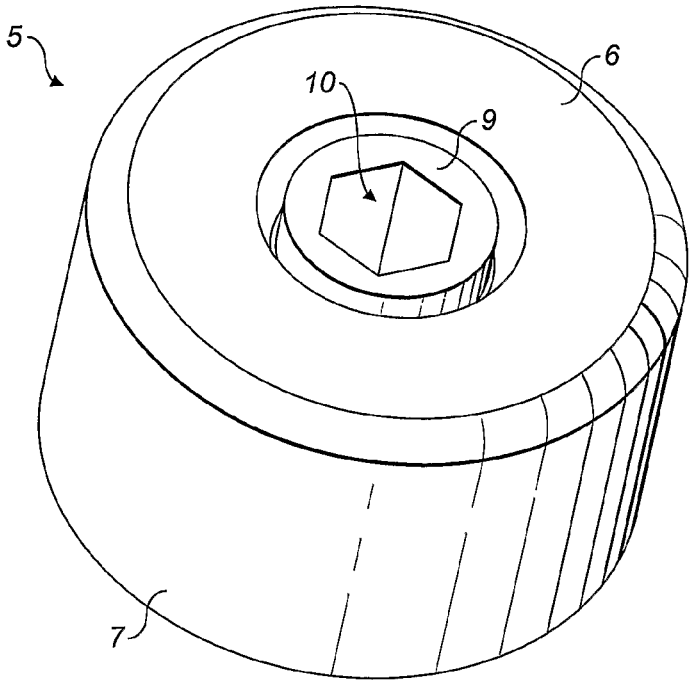
FIG. 1: shows an isometric view, from above, of a bottle cap according to the invention.

Referring firstly to FIG. 1, the invention provides a bottle cap 5 having an upper boundary 6; and an attachment skirt 7 which extends downwardly from the upper boundary 6 and serves, in the conventional manner, to provide the means whereby the cap 5 can be fitted to a bottle or other suitably configured form of container (not shown). As can be seen from FIG. 2, in this particular instance the skirt 7 is provided on the lower inner edge, with an annular ring 8 which, in use, co-operates with a lip on the bottle to enable the cap to be snap-fitted to the bottle. It will be appreciated, however, that the annular skirt could be attached to the bottle by other means including a screw thread.

The cap 5 has a detachable section 9 formed as an integral part thereof, the detachable section, as with the skirt 7, being arranged or contained below the upper boundary 6. The detachable section 9 includes a tool engaging socket 10, the form and operation of which will be described below.

Figure 2:
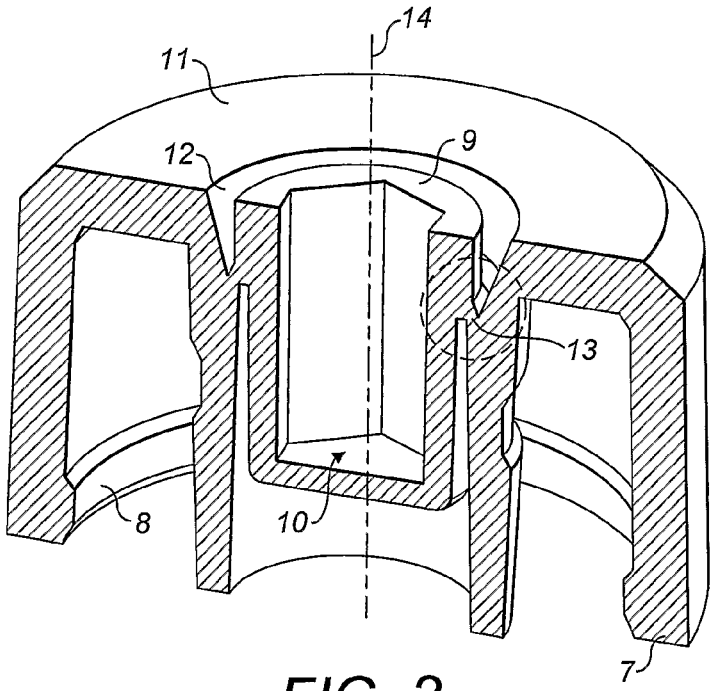
FIG. 2: shows an isometric sectional view through the cap shown in FIG. 1.

As can be seen from FIGS. 1 & 2, the upper boundary 6 is essentially a flat plane defined by the upper cap surface 11 and the upper edge of the detachable section 9. The detachable section is separated from the remaining upper cap surface 11 by an annular recess 12. At the foot of the recess the detachable section is joined to the remainder of the cap by an integral rib 13 of reduced thickness when compared with the thickness of the other sections of the cap. The reduced thickness allows the rib 13 to form a frangible joint or seal between the detachable section and the remainder of the cap.

Figure 3:
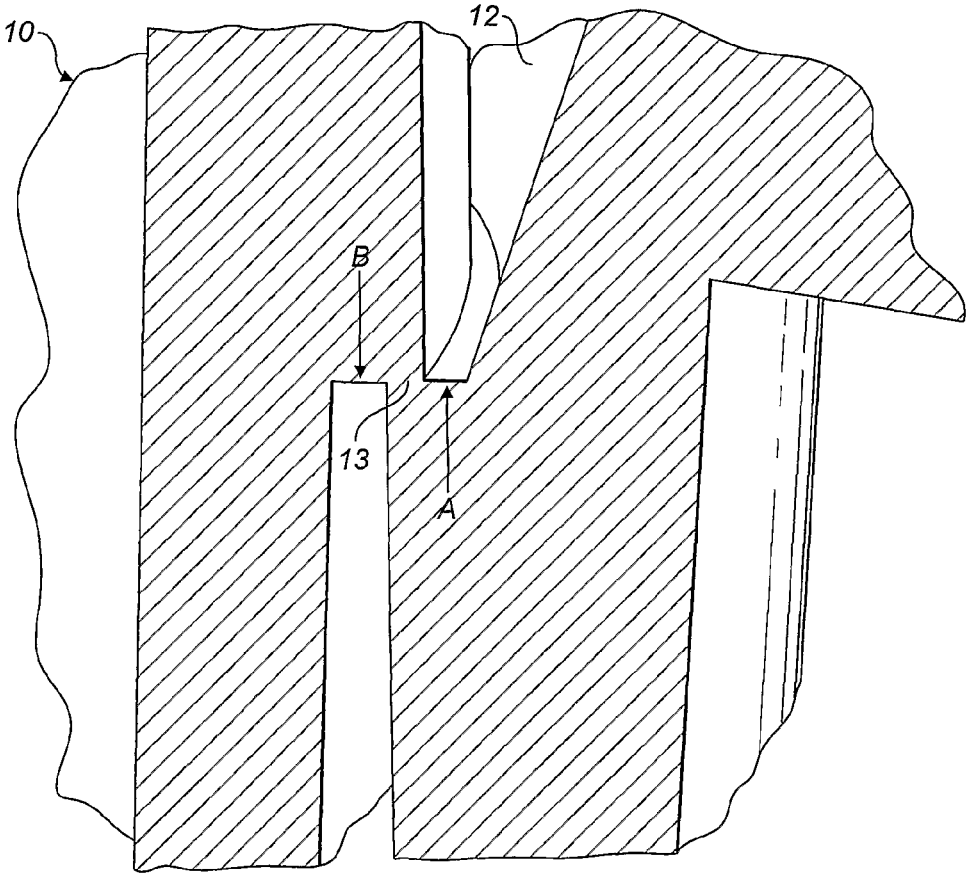
FIG. 3: shows an enlarged view of the area circled in FIG. 2.

The cap is configured so that the force required to break the joint or seal, defined by rib 13, is always greater than that which could be applied by simple manual force. The precise breaking force can be controlled by altering the depths of the recesses indicated as A and B in FIG. 3, relative to one another. With A and B directly in line the rupture line is perpendicular to the bottle cap axis 14, and the joint is weakest and most susceptible to rupture by a vertical force along the direction of the axis 14. With A extended towards the upper boundary 6, and/or B downwardly in the direction of the bottom of the cap, the rupture line assumes an angle with respect to the bottle neck axis, is lengthened, and the joint or seal is strengthened, particularly in the direction of the axis 14, directed into the bottle. Furthermore, when A and B are vertically spaced as shown in FIG. 3, it will be noted that the joint 13 is substantially vertically aligned in the sense that a part of the detachable section vertically overlies the rib 13 thus making the cap particularly strong in the vertical direction. Whilst this arrangement provides the strength necessary for the cap to endure transport without fear of breakage, the joint can still be broken by levels of torque that can be applied manually with the assistance of a suitable tool.

It will be further noted that the socket 10 projects below the frangible joint 13. This encourages a balanced or more pure torque to be applied to the joint 13 and reduces the tendency of the socket to twist in a vertical plane as torque is applied.

The precise dimensions and materials used can be determined easily by those versed in the art and confirmed empirically for individual cases.

It follows that manually applied force must be increased by mechanical advantage to effect breakage of the joint 13, hence the tool engaging facility 10 included within the detachable section 9. The tool engaging socket is preferably configured so that, in use, torque is applied to the joint 13. To this end, the tool engaging socket 10 can be configured to engage any of a wide range of tools used for insertion such as hexagonal (hex or Allen) keys, torx or screwdrivers and the disclosure contained herein is not limited to the use of a particular tool type, save that it is configured to provide mechanical advantage in a rotational sense. In the preferred embodiment described herein the tool engaging facility 10 comprises a hex socket which allows the insertion of a hex key and the application, to the detachable section 9, of an enhanced torque about the axis 14. This force, in turn, tears and breaks the rib 13, and allows the detachable section to be withdrawn, and access gained to the contents of the bottle.

It will be appreciated, particularly in the case of the working embodiment described herein, that a bottle cap formed according to the invention has the following benefits:

i) a non-projecting upper surface is provided and the overall height of the cap is no greater than that of a conventional bottle cap, thus minimizing secondary packaging requirements;

ii) The provision of a hex socket within the detachable section allows mechanical advantage to be applied to a twisting action on the detachable section, to break the seal or joint 13. Thus the seal is inherently strong and safe while passing through the distribution network;

iii) the cap seal can be broken without resort to potentially dangerous cutting tools and the seal, once broken is recessed below the upper boundary of the cap. This minimizes the chances of spillage when the container to which the cap is fitted, is full of liquid.

iv) The application of torque to the joint 13 leads to a tearing of the joint rather than the jerking breakage than occurs when vertical loads are applied to prior art devices. This further minimizes the chances of spillage.

It will thus be appreciated that a cap as described and claimed herein has particular advantages for consumables bottles for inkjet printers.

The invention claimed is:

1. A bottle cap having:

an upper boundary comprising a substantially flat planar cap surface and an attachment skirt depending from the periphery of, and below, said planar cap surface;

a detachable section defined by an annular recess in, and projecting below, said planar cap surface;

a frangible joint defined at the foot of said recess to connect said detachable section to the remainder of said cap; and a tool engagement socket within said detachable section, said socket protecting from said upper boundary to terminate below the position of said frangible joint, said socket being configured to allow the application of torque to said detachable section.

2. A bottle cap as claimed in claim 1 having an axis of symmetry passing through said upper boundary and co-axial with said attachment skirt, said cap being configured and arranged so that said detachable section is, in use, detached by the application of torque applied to said tool engagement socket about said axis of symmetry.

3. A consumables bottle for an inkjet printer having a bottle cap as claimed in claim 2.

4. A bottle cap as claimed in claim 1 wherein said tool engagement socket is configured to receive a hexagonal key.

5. A consumables bottle for an inkjet printer having a bottle cap as claimed in claim 4.

6. A consumables bottle for an inkjet printer having a bottle cap as claimed in claim 1.

7. A bottle cap as claimed in claim 1 wherein said frangible joint is aligned substantially vertically between said detachable section and the remainder of said cap.

* * * * *